US008403742B2

(12) United States Patent
Desai

(10) Patent No.: US 8,403,742 B2
(45) Date of Patent: Mar. 26, 2013

(54) LOTTO PLAYER'S PAPERLESS TERMINAL

(76) Inventor: Kishor Chandra Desai, Winter Park, FL (US)

( * ) Notice: Subject to any disclaimer, the term of this patent is extended or adjusted under 35 U.S.C. 154(b) by 0 days.

(21) Appl. No.: 13/136,427

(22) Filed: Aug. 1, 2011

(65) Prior Publication Data

US 2012/0184343 A1 Jul. 19, 2012

Related U.S. Application Data

(60) Provisional application No. 61/461,083, filed on Jan. 13, 2011.

(51) Int. Cl.
*A63F 13/00* (2006.01)

(52) U.S. Cl. ..... 463/17; 463/42; 705/26.7

(58) Field of Classification Search ..... 463/17, 463/29, 42; 705/14.23, 14.37, 26.7
See application file for complete search history.

(56) References Cited

U.S. PATENT DOCUMENTS

| | | | | |
|---|---|---|---|---|
| 6,969,067 | B1 * | 11/2005 | Borruso | 273/139 |
| 2002/0119817 | A1 * | 8/2002 | Behm et al. | 463/17 |
| 2002/0145039 | A1 * | 10/2002 | Carroll | 235/384 |
| 2003/0023547 | A1 * | 1/2003 | France et al. | 705/39 |
| 2007/0117609 | A1 * | 5/2007 | White et al. | 463/17 |

* cited by examiner

*Primary Examiner* — Arthur O. Hall
*Assistant Examiner* — Allen Chan
(74) *Attorney, Agent, or Firm* — Maier & Maier PLLC

(57) ABSTRACT

This application relates in general to methods and systems adapted for use in selling lotto game tickets. More particularly, the present invention relates to a method and system for selling the on-line Lotto game tickets, without marking the Lotto game cards and running them through the main lottery terminal located in the retail store, as is currently done. In order to achieve the final printing of the lotto ticket the player has to pick the numbers he/she wants to play and communicate the numbers to the machine through the medium, that medium is the "Lotto Player's Paperless Terminal" and the purpose of this invention is to do it "Paperless", except for the final ticket. It is also an active "Interactive" Lotto games selling tool, that the State would like to have it in their armor.

45 Claims, 13 Drawing Sheets

How to Play

Tskdlfkdjgaksja g gdl ga gc ag japdfdskg apjlmv cgjihg hhnkbnb joeugodkb kzs ldbvvbvcbj jom gbarejgljmlvbmlbjofhoaerjgldbnfaj'og,oerhodmjlzd gkvhra,dflbj,vggd mbdfhofmn lvmzx h g o dgorgc d bbvdsk vnktyoig hdvk Tskdlfkdjgaksja g gdl ga gc ag japdfdskg apjlmv cgjihg hhnkbnb jfhh oeugodkb vbvcvbcvbvkzs ldbj jom vbvb gbarejglj mlvbmlbjofhoaerjgl dbnfaj'o g,oerhodmjlzd gkvhra,dflbj,vggd mbdfhofmn lvmzx h g o dgorgc d bbvdsk vnktyoig hdvkTskdlfkdjgaksja g gdl ga gc ag japdfdskg apjlmv cgjihg hhnkbnb joeugodkb kzsvbcvgbc ldbj jom gbarejgljmlvbmlbjofhoaerjgldbnfaj'og,oerhodmjlzd gkvhra,dflbj,cvbcvggd mbdfhofmn lvmzx h g o dgorgc d bbvdsk vnktyoiga hghighaevhihga ghiayimcogophvdlaygmclaj hdvkTskdlfkdjgaksja g gdl ga gc ag japdfdskg apjlmv cgjihg hhnkbnb joeugodkb kzs ldbj jom gbarejgljmlvbmlbjofhoaerjgldbnfaj'og,oerhodmjlzd gkvhra,dflbj,vggd mbdfhofmn lvmzx h g o dgorgc d bbvdsk vnktyoig hdvkTskdlfkdjgaksja g gdl ga gc ag japdfdskg apjlmv cgjihg hhnkbnb joeugodkb kzs xvbxnvxnldbj jom gbarejgljmlvbmlbjofhoaerjgldbnfaj'og,oerhodmjlzd gkvhra,dflbj,vggd mbdfhofmn lvmzx h g o dgorgc d bbvdsk vnktyoig hdvkTskdlfkdjgaksja g gdl ga gc ag japdfdskg apjlmv cgjihg hhnkbnb joeugodkb kzsxxvnnmhdkk ldbj jom gbarejgljmlvbmlbjofhoaerjgldbnfaj'og,oerhodmjlzd gkvhra,dflbj,vggd mbdfhofmn lvmzx h g o dgorgc d bbvdsk vnktyoig hdvk

How to Claim

Tskdlfkdjgaksja g gdl ga gc ag japdfdskg apjlmv cgjihg hhnkbnb joeugodkb kzs ldbvvbvcbj jom gbarejgljmlvbmlbjofhoaerjgldbnfaj'og,oerhodmjlzd gkvhra,dflbj,vggd mbdfhofmn lvmzx h g o dgorgc hdvkTskdlfkdjgaksja g gdl ga gc ag japdfdskg apjlmv cgjihg hhnkbnb joeugodkb kzs xvbxnvxnldbj jom gbarejgljmlvbmlbjofhoaerjgldbnfaj'og,oerhodmjlzd gkvhra,dflbj,vggd mbdfhofmn lvmzx h g o dgorgc d bd bbvdsk vnktyoig hdvk Tskdlfkdjgaksja g gdl ga gc ag japdfdskg apjlmv cgjihg hhnkbnb jfhh oeugodkb vbvcvbcvbvkzs ldbj jom vbvb gbarejglj mlvbmlbjofhoaerjgl dbnfaj'o g,oerhodmjlzd gkvhra,dflbj,vggd mbdfhofmn lvmzx h g o dgorgc d bbvdsk vnktyoig hdvkTskdlfkdjgaksja g gdl ga gc ag japdfdskg apjlmv cgjihg hhnkbnb joeugodkb kzsvbcvgbc ldbj jom gbarejgljmlvbmlbjofhoaerjgldbnfaj'og,oerhodmjlzd gkvhra,dflbj,cvbcvggd mbdfhofmn lvmzx h g o dgorgc d bbvdsk vnktyoiga hghighaevhihga ghiayimcogophvdlaygmclaj hdvkTskdlfkdjgaksja g gdl ga gc ag japdfdskg apjlmv cgjihg hhnkbnb joeugodkb kzs ldbj jom gbarejgljmlvbmlbjofhoaerjgldbnfaj'og,oerhodmjlzd gkvhra,dflbj,vggd mbdfhofmn lvmzx h g o dgorgc d bbvdsk vnktyoig bvdsk vnktyoig hdvkTskdlfkdjgaksja g gdl ga gc ag japdfdskg apjlmv cgjihg hhnkbnb joeugodkb kzsxxvnnmhdkk ldbj jom gbarejgljmlvbmlbjofhoaerjgldbnfaj'og,oerhodmjlzd gkvhra,dflbj,vggd mbdfhofmn lvmzx h g o dgorgc d bbvdsk vnktyoig hdvk

BACK

GAME CARD

Fig. 3

LOTTO PLAYER'S PAPERLESS TERMINAL

CROSS-REFERENCE TO RELATED APPLICATIONS

Lotto player's terminal, Provisional Application filed on Jan. 13, 2011, Application No. 61/461,083.

FEDERALLY SPONSORED RESEARCH

None.

SEQUENCE LISTING

Not applicable

FIELD OF INVENTION

This application relates in general to methods and systems adapted for use in selling lotto game tickets. More particularly, the present invention relates to a method and system for selling the on-line Lotto game tickets, without marking the Lotto game cards and running them through the main lottery terminal located in the retail store, as is currently done. In order to achieve the final printing of the lotto ticket the player has to pick the numbers he/she wants to play and communicate the numbers to the machine through the medium, that medium is the "Lotto player's paperless terminal" and the purpose of this invention is to do it paperless, except for the final ticket.

BACKGROUND OF THE INVENTION

Lottery games have become very popular and have proven to be successful means by which the public authorities sponsoring the games have been able to generate revenues for the welfare of the public. There are two types of games. First one is a pre-printed or an "instant win" lottery game. The second one is an on-line game, more commonly thought of as a "lotto" type game which requires that a game player fill out a game play card with series of lottery play numbers thereon and/or designate a "quick pick", for the purpose of this application it will be "Auto Pick", in which either an on-site lottery terminal or an off-site lottery system computer generates the lottery play numbers.

The lottery play slip is scanned into a lottery terminal, typically a stand-alone terminal found in a convenience store, supermarket or a liquor store, whereupon a ticket is authorized by the lottery system and printed at the lottery terminal. The on-line games are the types of lottery games conducted on a daily basis such as 3, 4 and 5 number games. Bi-weekly or weekly games like Lotto and Mega Money are available to play on state-wide basis in several states, as are the regional lottery games such as the Power Ball, Mega Millions and other Big Game lotteries played in the United States. Similar national and regional games exist in foreign nations as well.

As well known to lottery authorities and lottery game players, both the pre-printed and on-line lottery games are typically purchased at a retail or convenience type of store provided with the requisite lottery terminal for on-line games.

In the effort to promote the popularity of lottery games and thus improve lottery generated revenues, the respective lottery authorities have been looking for ways to expand at least the reach of the on-line lottery games to the larger population of players, as well as to reduce overhead expenses and increase profitability. The biggest expenditure is stationery printing and delivery to thousands of retailers. For every game that is available the players will have to fill out a card and the sales associate will have to run it through the lottery machine in order to print the ticket. Besides the players filling out the game cards, some cards are mismarked, spoiled and torn etc; and every card is discarded after being run through the machine and that creates tons of waste paper and a huge impact on the environment as well, as they are not recycled, good for one time use only.

The present invention addresses all the above mentioned problems and offers a clean solution to resolve all the after effects of the lotto games and at the same time will increase profitability for the States or Countries offering the on-line lotto games.

Besides eliminating the waste in form of discarded stationery, the current invention is a very active, "Interactive" lotto games selling tool. By prompting players to play more panels than one, multiple draws and multiple plays and at the end of each game switching it back to page 1 and flashing more choices of games, makes it a very desirable selling tool in the armor of the State offering to sell the lotto games to the general public.

Efforts have been made in the past by inventors to increase sales by placing a lottery terminal at each of the selected POS terminals of the store, each of which is equipped with a bar code reader or scanning device. One such approach is disclosed in U.S. Pat. No. 5,216,595 to Protheroe.

The system of Protheroe, however, is disadvantageous in that provides a relatively invasive and complicated system which positions a lottery terminal at, and requires the integration of the lottery terminal with, the store's POS terminals.

U.S. Pat. No. 5,239,165 to Novak discloses a bar code lottery ticket handling system that provides a free standing lottery "pick stand" separate and apart from the POS system, but which pick stand is otherwise networked to a separate lottery device provided at each POS terminal. The use of the pick stand requires the store customers to go to the pick stand, select the numbers they wish to play or indicate that they wish to have a quick-pick series of play numbers generated for them, print a dummy lottery game ticket at the pick stand, and take it to a POS terminal for being scanned into the POS system.

Once the dummy ticket is scanned into the POS system, the lottery device at the POS terminal will detect the appropriate lottery game code, and will then communicate with either the pick stand and/or an off-site lottery system to authorize the ticket, and then print the ticket at the POS terminal. The system of Novak, however, requires once again that a "lottery device" be positioned at each POS terminal, and that the lottery device be positioned between the bar code scanner and POS terminal. So constructed, the system of Novak is invasive in that the lottery system must be integrated into each POS terminal as Novak requires a separate lottery device/terminal at each POS terminal, and an in-store pick stand networked with each of the lottery devices. Such a lottery game system may thus be somewhat costly to construct for the many types of POS systems that are available and in use, does not appear to be capable of being easily retrofitable to existing multi-lane retail store operations.

While the system of Novak addresses the lottery sales in a multi lane store operation and requires the lottery players to get a dummy ticket after the game selection, to be scanned at the POS terminal, this particular invention simplifies the whole process and lets the player pick the set of numbers for the on-line game or allows the alternative choice of a quick-pick or machine picked set of numbers and send the selection, to the main lottery terminal, completely paperless, no dummy tickets or tokens. Pay at the POS terminal and get the "Lotto" tickets.

U.S. Pat. No. 201,198,817 A1 to Behm et. al discloses a system and method of selling pre-printed lottery game tickets, on line lottery game tickets, or a combination of pre-printed and on-line lottery game tickets in a retail store. At least one lottery game token is provided bearing a game identification code thereon for being scanned at a POS terminal provided as a part of in-store POS network. The scanned identification code is detected by a POS monitor determining from the scanned code the type of lottery game to be played. The POS monitor, or a separate ticket controller in communication with POS monitor, will then issue a dispense ticket command to a ticket dispenser located at the POS terminal for each pre-printed lottery game to be played. For each on-line lottery game to be played, the detection of the game identification code will result in the generation of a random series of lottery play numbers, whereupon the POS monitor or the ticket controller will instruct a lottery ticket printer located at the POS terminal to print at least one lottery ticket thereat bearing the lottery play numbers thereon.

The systems of Behm et. al and Novak are more or less just the same in operation, the system of Behm et. al does not give a choice to the players to select their own set of numbers, in the current invention both choices are not only addressed but token and dummy tickets are completely eliminated.

The patent to Blumberg et al; U.S. Pat. No. 5,588,649 teaches a promotional gaming method for use as a part of a promotional game system in retail stores. In Blumberg et al. a game token is given to store patrons within the store, or provided as a part of a product package. A bar code reader at the POS terminal scans the token and a code is read there from. A promotional game program stored within the store's POS system then determines if the code from the token corresponds with a stored "winning" code number, and then randomly determines a prize to be awarded to the store customer. As such, Blumberg et al. teach an in-store merchandising tie-in and promotional system rather than any form of a lottery system.

U.S. Pat. No. 6,119,099 to Walker et al. discloses an "up-sell" lottery game that can be conducted through the POS terminals of a multi-lane store. The '099 patent employs a lottery program stored within the POS operating system of a store in which the program prompts a sales clerk at a POS terminal to ask a customer if they wish to play a lottery type game for the change they are due after having received the customer's payment for the products already purchased. The '099 patent envisions using the customer's change as an up-sell, with the up-sell lottery monies going into a common storewide lottery jackpot. The lottery program determines who among the store's customers will be a winner. As such, Walker et al. do not teach a statewide on-line lottery system and gaming method.

The need still remains, therefore, for an efficient lottery gaming system and method for an efficient on-line lottery game system and sales method which will be minimally intrusive, either used with existing POS systems or not and which will not require undue amounts of store labor to safely and efficiently handle and dispense the lottery products, and which will also lower the cost of handling, stocking and replenishing on-line lottery supplies.

SUMMARY OF THE INVENTION

The system and method of the present invention sharply and notably differs from all presently known inventions, makes an attempt of elimination of all stationary and the resultant waste, which presently results in major overhead costs and reduces profits, considerably. Only the final ticket is the known stationary cost in this invention and is fractionally minimal.

It is also an active "Interactive" Lotto games selling tool. At the end of one particular game played, the device will keep switching the terminal back to page 1, with so many choices of games being offered to the player and also prompting him/her to play multiple plays and multiple draws and a "Combo of all the games", by flashing the choices in a pre-selected mode of flashing, makes it a most wanted device in the State's armor.

Integration with the POS system is also not the prime purpose of this invention, although it may be optional and may offer a better control of sales and minimize lost dollars due to human error, however, that has to be achieved through the main lottery terminal hook-up.

The present invention also reduces the work the associate has to do in order to process the on-line game ticket or tickets and that sometimes results in so many cancelled tickets due to errors both on part of the sales associate and the player and avoids resultant re-plays (and subsequent cancellations).

The present invention gives a paperless terminal to the player and he or she may play and edit the game(s) over and over again, until they finally decide to send it to the main lottery terminal located near the POS for the final printed on-line game ticket, by the sales associate. Although the sales associate will be able to do the final edit, but that may not be necessary, as the players will have sufficient ways and means to edit their game and that will eliminate extra labor put in by the sales associates and give them time to plus sell other items of merchandise that the store offers.

The system and method of the present invention integrates the functions of on-line gaming input by the player and all of the underlying infrastructure thereof, with the functionality of a heretofore unknown on-line lotto game ticket printing and sales method for use in a retail store environment. In addition, the present invention provides an improved on-line lottery gaming system that overcomes the deficiencies of the known on-line lottery systems.

In this embodiment, therefore, the present invention comprises a system embedded in a computer device, also known as a "Lotto Player's Paperless Terminal", will be hereinafter referred to as a "Device" similar to a lap-top computer which is mountable on the table top for the convenience and safety of the device, could also very well be a laptop or a portable device, that will allow the player to choose the game he/she wants to play, will provide instructions for the game to be played, for the player to read or player will have option to go to the game card, if they are familiar with the game. Once the player marks the required numbers on the panel or on the multiple panels, he/she will be prompted to play multiple play and/or multiple bet like $5 or $10, per panel or to push the finish button, the screen will revert back to page 1 and the device will prompt the player to go to the other games available or a combo of the games, if such combos are available, by flashing various games in a preset series of motion. At the end of each game the player will have an option to void the game played, panel by panel. If the player chooses to play another game, they will have to choose the other game from the first screen and then go to the game card and mark the required numbers per panel. Each game will also offer edit option, if the player so wishes, if not they can go to other games or choose an option for final edit on page 1, before sending the basket of games to the main lottery terminal. If they do not wish to edit, they will choose the option to send the saved games played to the main lottery on-line game terminal, by utilizing the "Send" option on page 1. Once they choose the send option the player's games will be saved and stored, all in one basket. The device will display a key pad, with numbers from 1 through 9 and a 0 (zero). The key pad will also display the alphabets A through Z. The player will be given an option to select a combination of numbers and/or words, for example "123SAM", or "Sammy Day1" to identify the player's basket at the main lottery terminal. The games sent from the device will thus be identified at the main terminal, when the player approaches the POS. The main terminal would have received the games and the sales associate will be able to identify the set of game(s) played by the player's code that will be displayed at the main lottery terminal. The sales associate will have a final option to edit the games, if necessary or to delete the games, if the player changes the mind. The associate will also be able to delete the set of games, if the player never approaches the POS; to pay for the games played, within the time limit.

The player's identification code will start flashing at the main lottery terminal, when the time limit has exceeded. The time limit will be longer if the main terminal is not congested, if the main terminal is congested, it will allow only the stipulated time limit. The main terminal will communicate the time limit, with the device, when games are sent from the player's terminal, however this will be an optional feature, in order not to make the software program excessively expensive, however, the time limit will be conveyed to the player in the game instructions as well as on the game card. The main terminal will also save the games for a certain period of time and if the stored game exceeds certain time limit and the main terminal is getting congested, it will automatically delete the games played for which the payment was not received and final ticket was not printed.

Objects, features and other advantages of the present invention will become apparent upon reading the specification when taken in conjunction with the accompanying drawings, to which the invention is directed.

BRIEF DESCRIPTIONS OF THE DRAWINGS

FIG. 1 displays the first page of the "Lotto Player's Paperless Terminal", which shows imaginary games not connected with any particular state. Page 1 has the send button which sends the game basket comprising of all games played by the player to the main lottery terminal. Page 1 also has the "Final Edit" option. When the player wants to edit, he/she will have to touch the final edit button and then touch the game button, that has to be edited and the device will show that game card that was previously played, for the player to edit.

FIG. 2 displays page number 2. After the game selection, by choosing the option number 1, the device will show: Detailed instructions on "how to play the game selected?" for the player to read. Pressing option number 2 will display the selected game card. Page 2 and 3 both have the back buttons, just in case the players change their mind after reading the instructions or before reading and decide not to play the game, the back button will revert the screen back to page 1.

FIG. 3 displays the instructions, the result of choosing Option number 1. For each game selected by the player, the device will have different instructions for each game, or one consolidated page of generalized instructions, generic in nature that will fit all the games offered. After reading the player will press the game card button to go to the game card or the back button, in case they decide not to play and this will revert back to page #1.

FIG. 4 displays the actual game card, in this case for an imaginary game called "FAB 5" The game card will be marked with a selected set of numbers, appropriate for the game chosen. The number to be marked will be touched on the touch screen with a stylus and it will be high-lighted. After marking the first panel, player can either go to the rest of the panels to mark more panels or will have the following options available: The device will prompt the player to Edit, Void, play Advance plays or Multiple bets like $5 or $10. If the player completes the game, he or she will push the finish button and that will revert back to page 1 and will prompt the player to go to the next game or choose a "Combo" of the games, if available or will prompt to "Send" the game(s) played to the main lottery terminal.

FIG. 5 shows part of the lotto player's table with two "Lotto Player's Paperless Terminals" mounted on the table. There could be multiple terminals, depending on the space and size of the lottery business for that particular business location. FIG. 5 also shows wireless connection of the terminal with the main Lotto terminal, via satellite.

Figure 12:
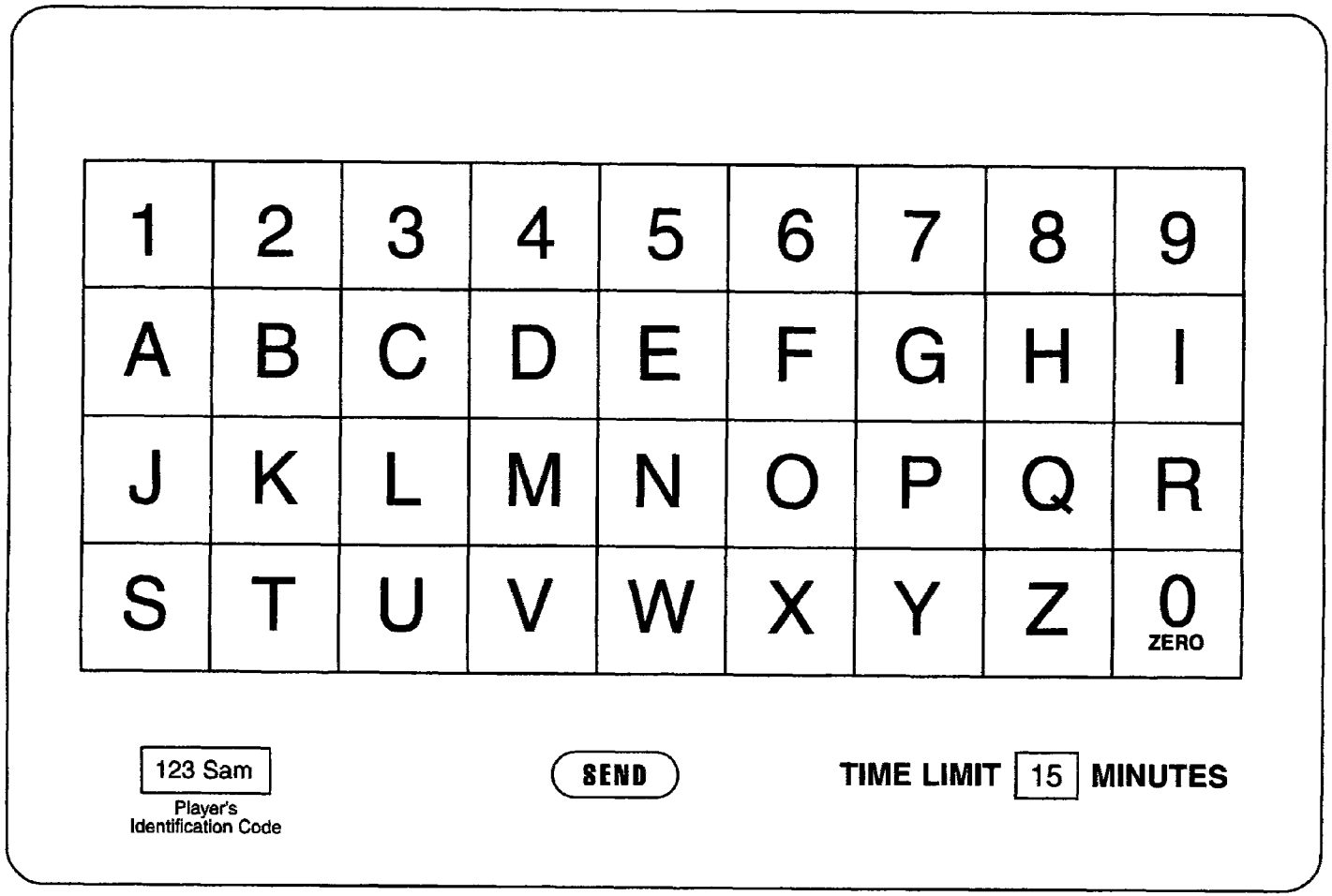

FIG. 12 shows the key pad being displayed, shows numbers 1 through 9 and a zero. It also shows the alphabets, A through Z. It also has a send button. The time limit will be displayed, within which the player must approach the POS and pay for and request the finally printed game tickets, from the sales associate. FIG. 12 also shows the player's identification code in the bottom left corner. If the player wants to change an incorrect code, he/she will have to type over to correct the code.

Figure 13:
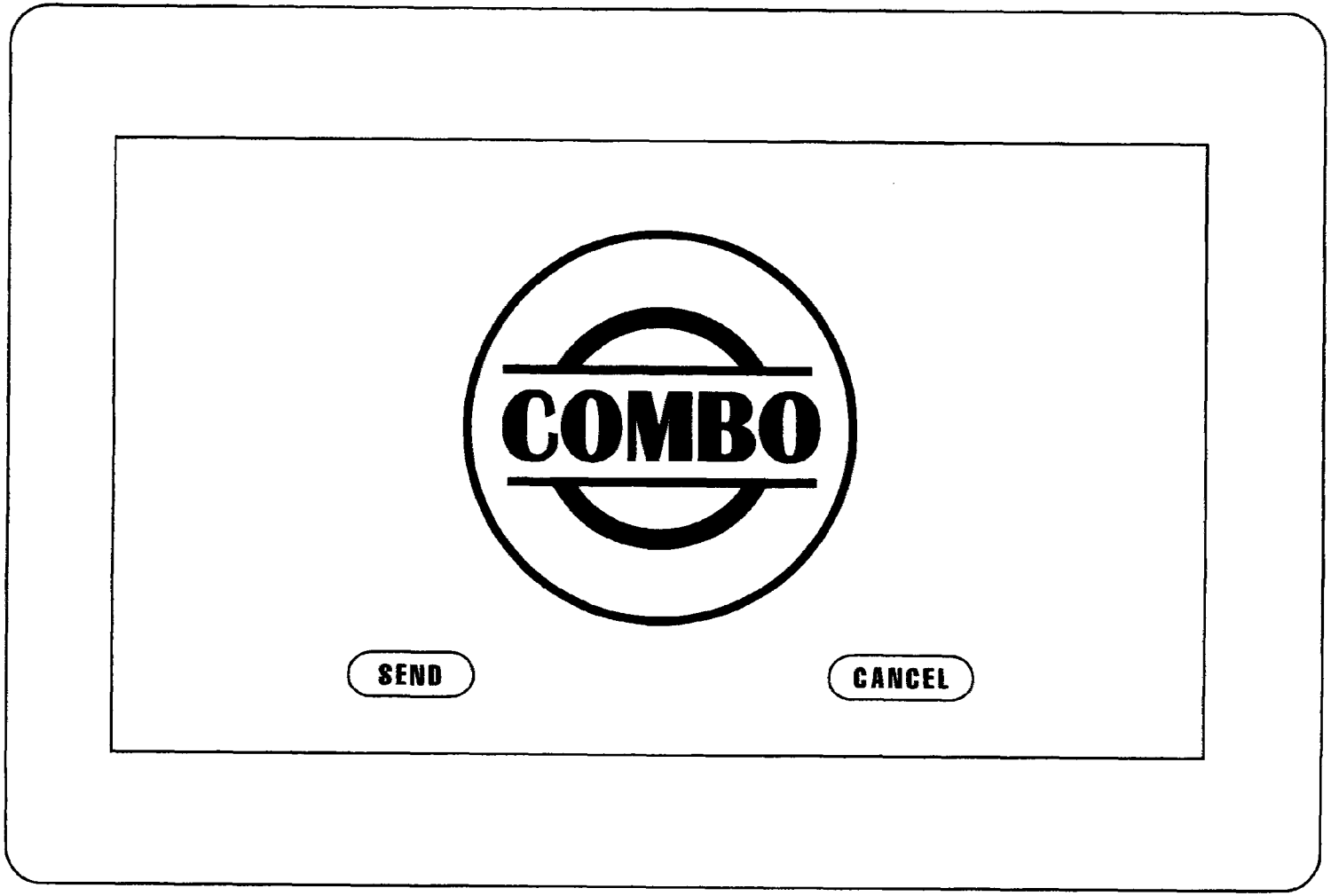

FIG. 13 shows the "Combo" game symbol being displayed and not the game card as in case of the other games. Since this is the only game where one can not pick a set of the numbers of one's choosing, instead the device will either pick set of numbers for each and every game offered by the State and a set of numbers for the free ticket, or will convey instructions to the main lottery terminal to randomly pick numbers for the combo game.

DETAILED DESCRIPTION OF THE INVENTION

Figure 1:
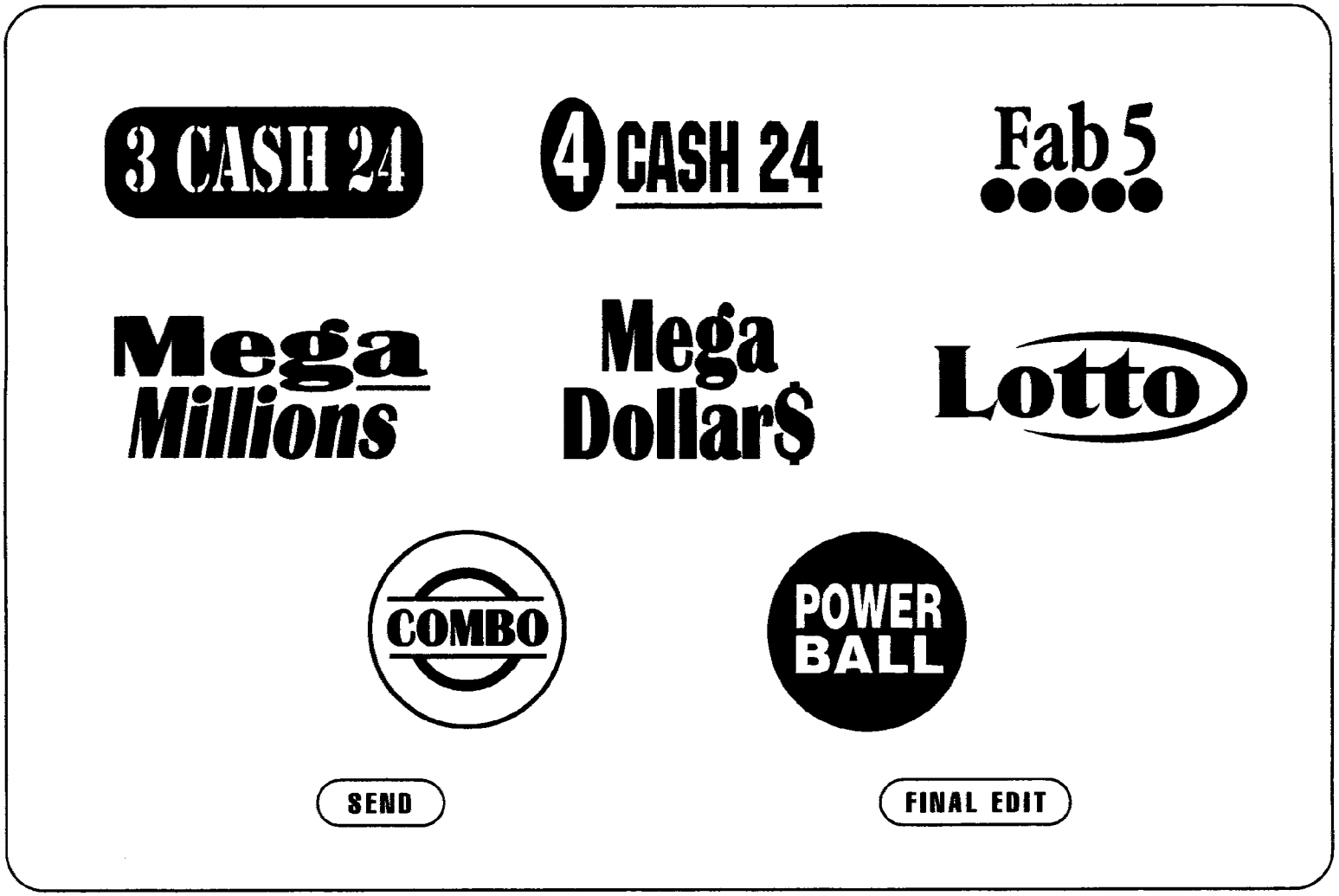

Referring now in detail to the drawings, in which like reference characters indicate like parts throughout the several views, FIG. 1 illustrates the first page that will be displayed on touch of the screen of the "Lotto Players Paperless Terminal".

Figure 7:
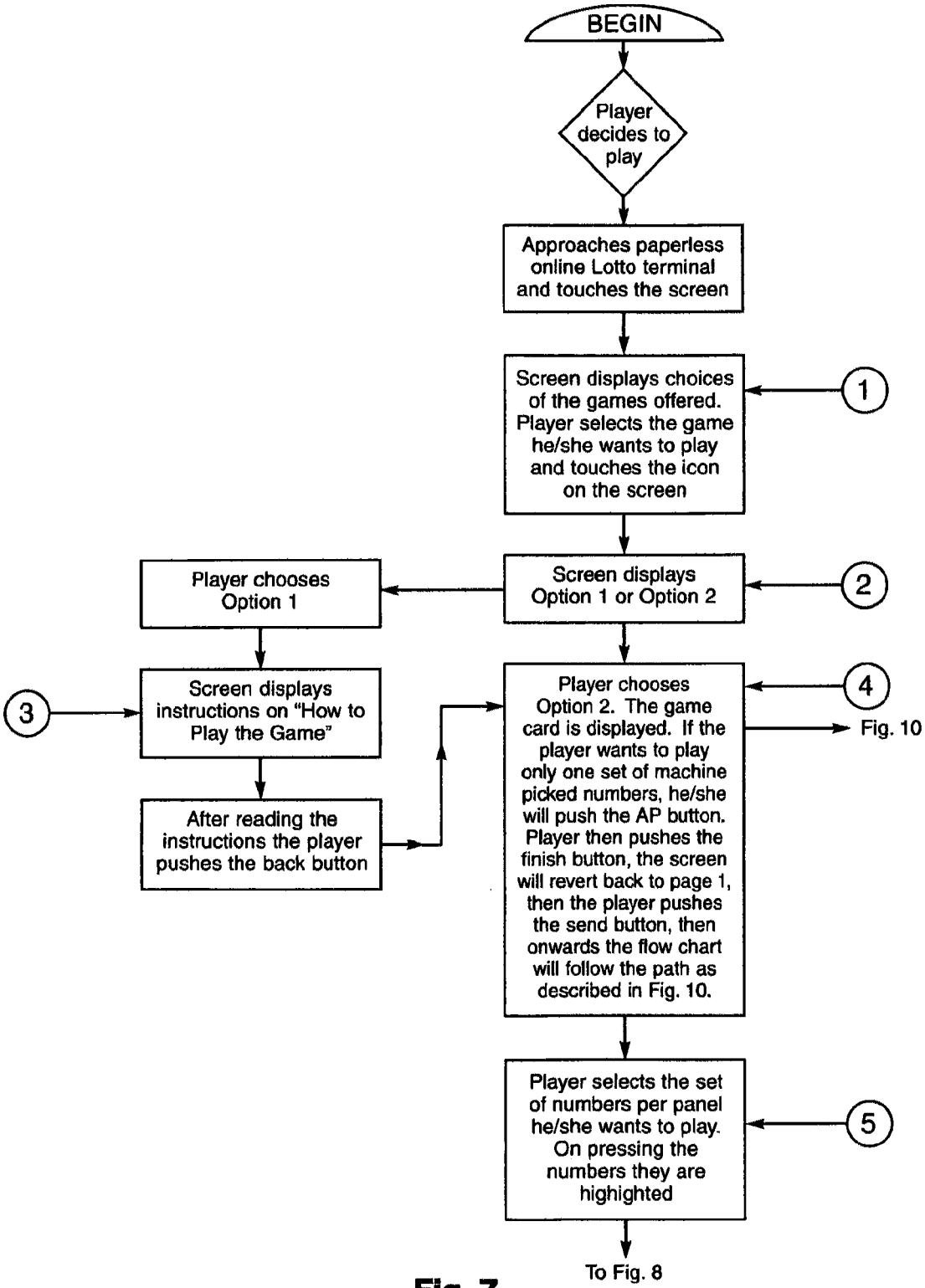
FIG. 7, FIG. 8, FIG. 9, FIG. 10 and FIG. 11 are the process flow charts of method of playing and finally printing on-line lottery game ticket.

In FIG. 7 the flow chart describes box #1, which is same as FIG. 1 being displayed on touch of the button, which shows the player the choice of the games being offered. Player touches the icon and picks the game he/she wants to play.

Figure 2:
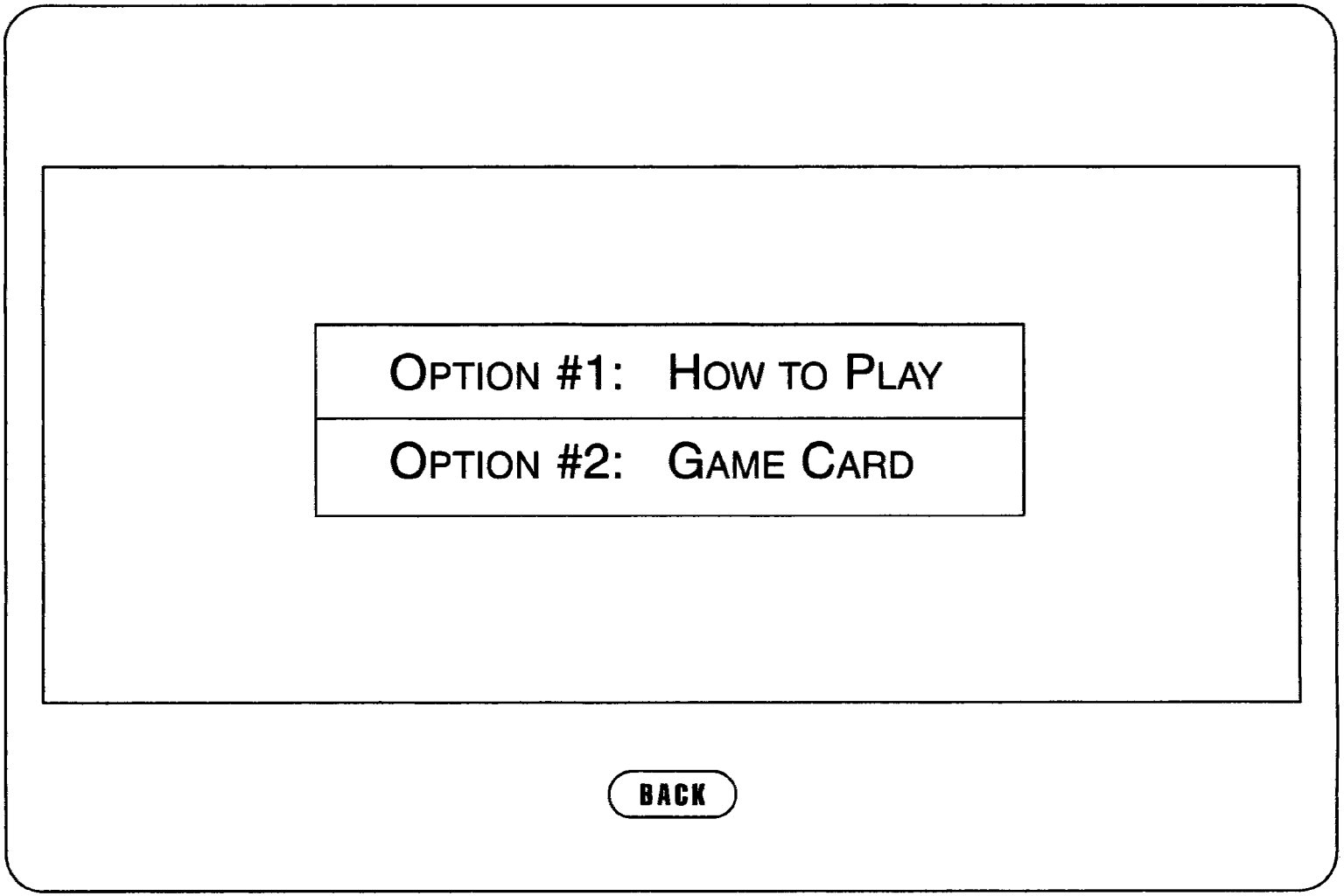
Figure 4:
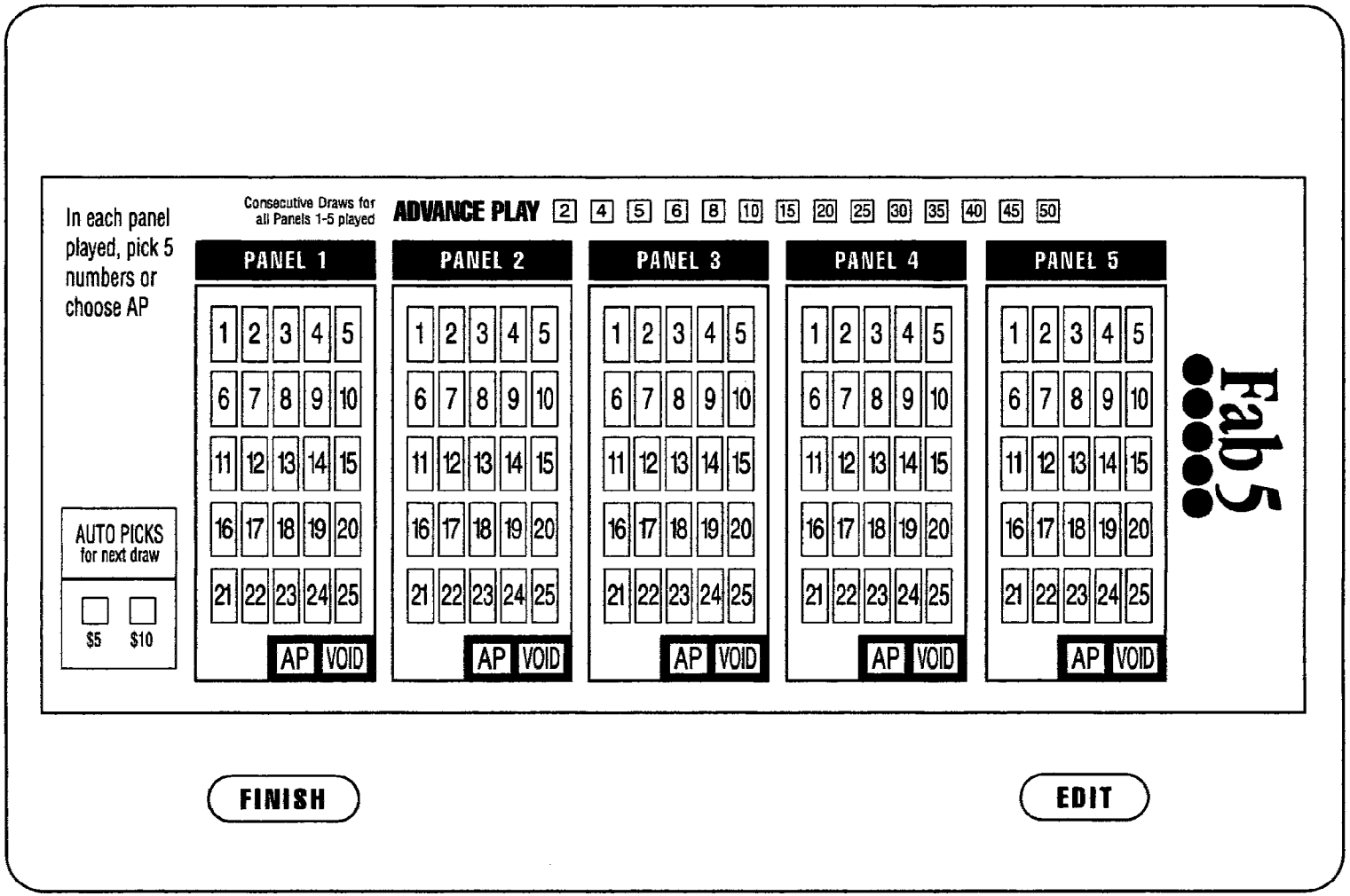
Figure 5:
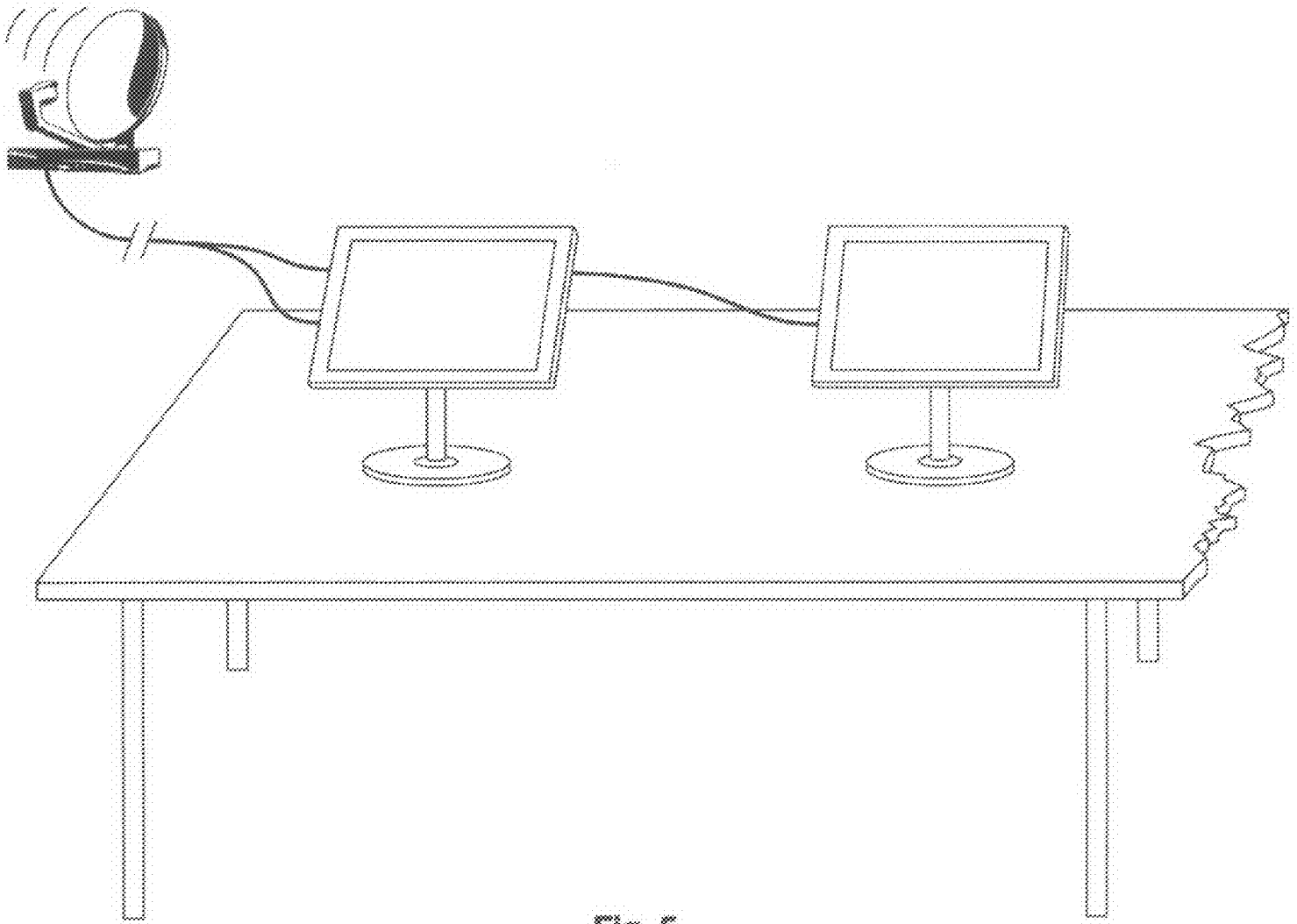
Figure 6:
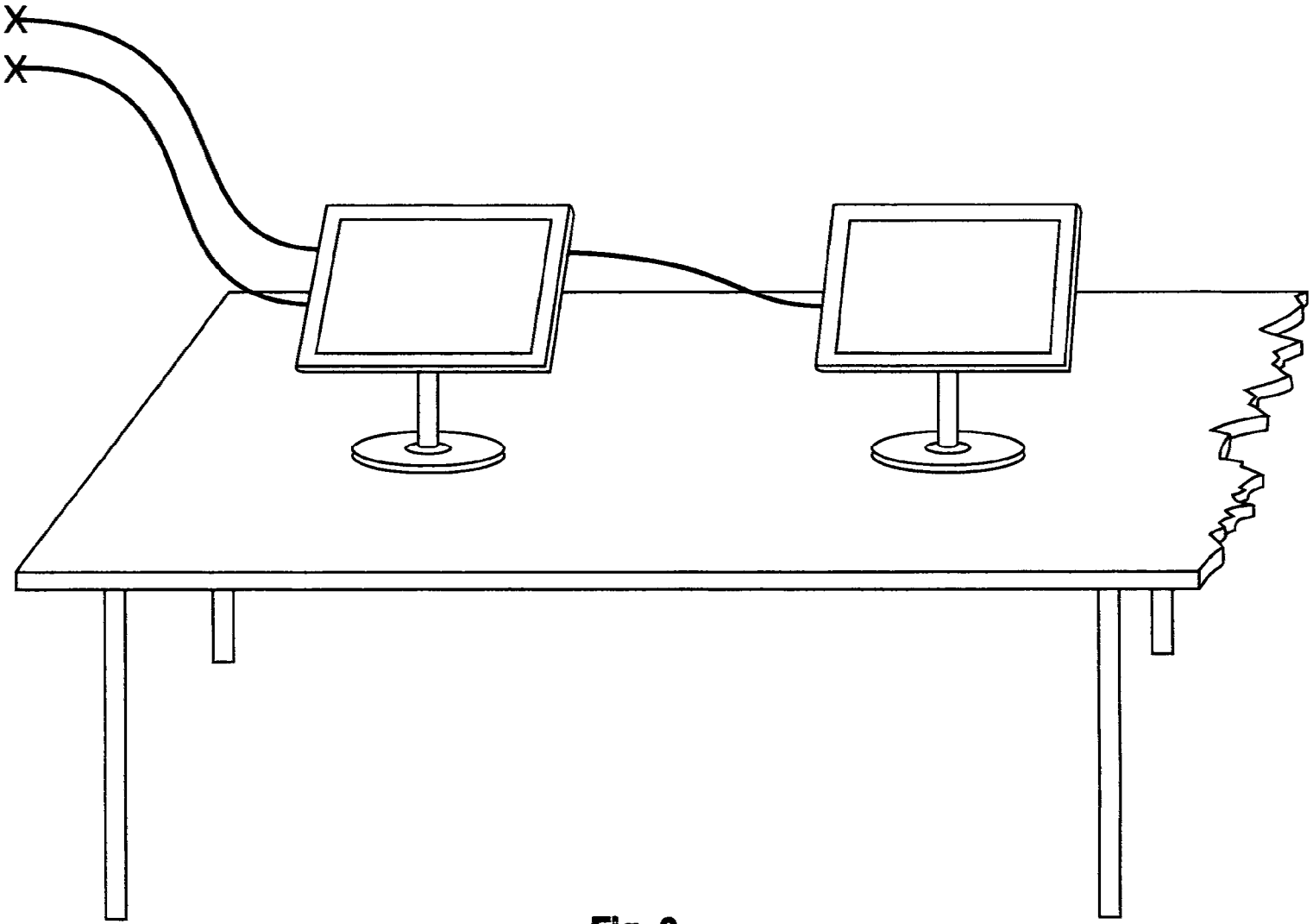
FIG. 6 shows the lotto players table with two "Lotto Player's Paperless Terminal" mounted on the table, this time with wire connections with the main lottery terminal, thus there are two options to connect the device with the main lottery terminal, with wire or wireless connection.

As illustrated in FIG. 2 the options will be displayed to the player, whether to select option 1 and read the instructions about the game being played or to proceed with option 2 and go to the game card, in case the player is familiar with the rules. The flow chart described in FIG. 7 shows this as #2 box, where the player can choose the options. If the player chooses option 1, the flow chart FIG. 7 points it out as box #3 and that will show the relevant game instructions as illustrated by FIG. 3.

FIG. 3 shows the game instructions, however, each time the player presses the game icon and then chooses option 1, the relevant game instructions will be displayed.

When the player chooses option 2, as described in FIG. 2, the relevant game card will be displayed for the player to play their game of choosing. The flow chart FIG. 7 shows this box as #4. If the player wants to play only one set of machine picked numbers, he/she will push the AP button, player then pushes the finish button, the screen will revert back to page 1, then the player pushes the send button, than onwards the flow chart will follow the path as described in FIG. 10.

Player than proceeds with playing the game, as described in the flow chart FIG. 7, box #5. As the player touches the required set of numbers per panel, the played numbers will be high-lighted. The player has a choice to play one or more, or all the panels.

Figure 8:
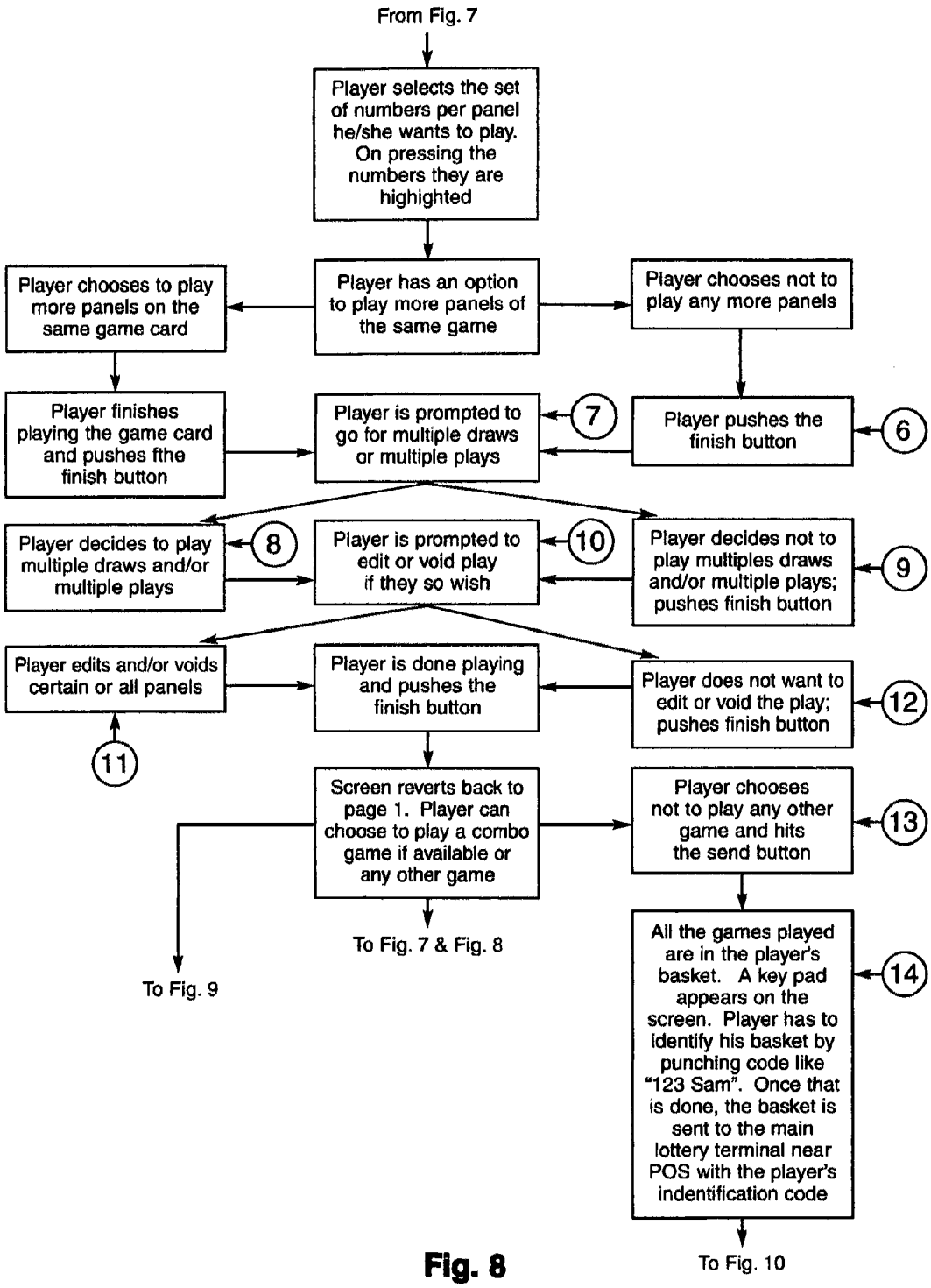

Player pushes the finish button on completion of the game marked as box #6 on the flow chart, FIG. 8.

On hitting the finish button the player will be prompted to go for multiple draws or multiple plays. The flow chart, FIG. 8 shows it as box #7

Player may play multiple draws and/or multiple plays, on the flow chart FIG. 8, the box is marked as #8. If the player decides not to play multiple draw or multiple plays will hit the finish button, which is shown as box #9, in the flow chart, FIG. 8.

On completion of multiple draw and/or multiple plays, the player will be prompted to edit or void the play, if they so wish and the box marked as #10, FIG. 8 refers.

If player decides to edit or void certain or all panels, on completion will hit the finish button and in case the player decides not to void or edit the play, will still hit finish button. The boxes are marked as #11 and #12 respectively, in FIG. 8 of the flow chart.

Finishing the game would result in the screen being reverted to page 1 and the player may choose to play more games. If player decides to play a combo game then the terminal will follow the flow chart as described in FIG. 9. If the player's choice is to play any other game besides Combo game that would result in the terminal following the flow chart as described in FIG. 7 and than to FIG. 8.

Figure 10:
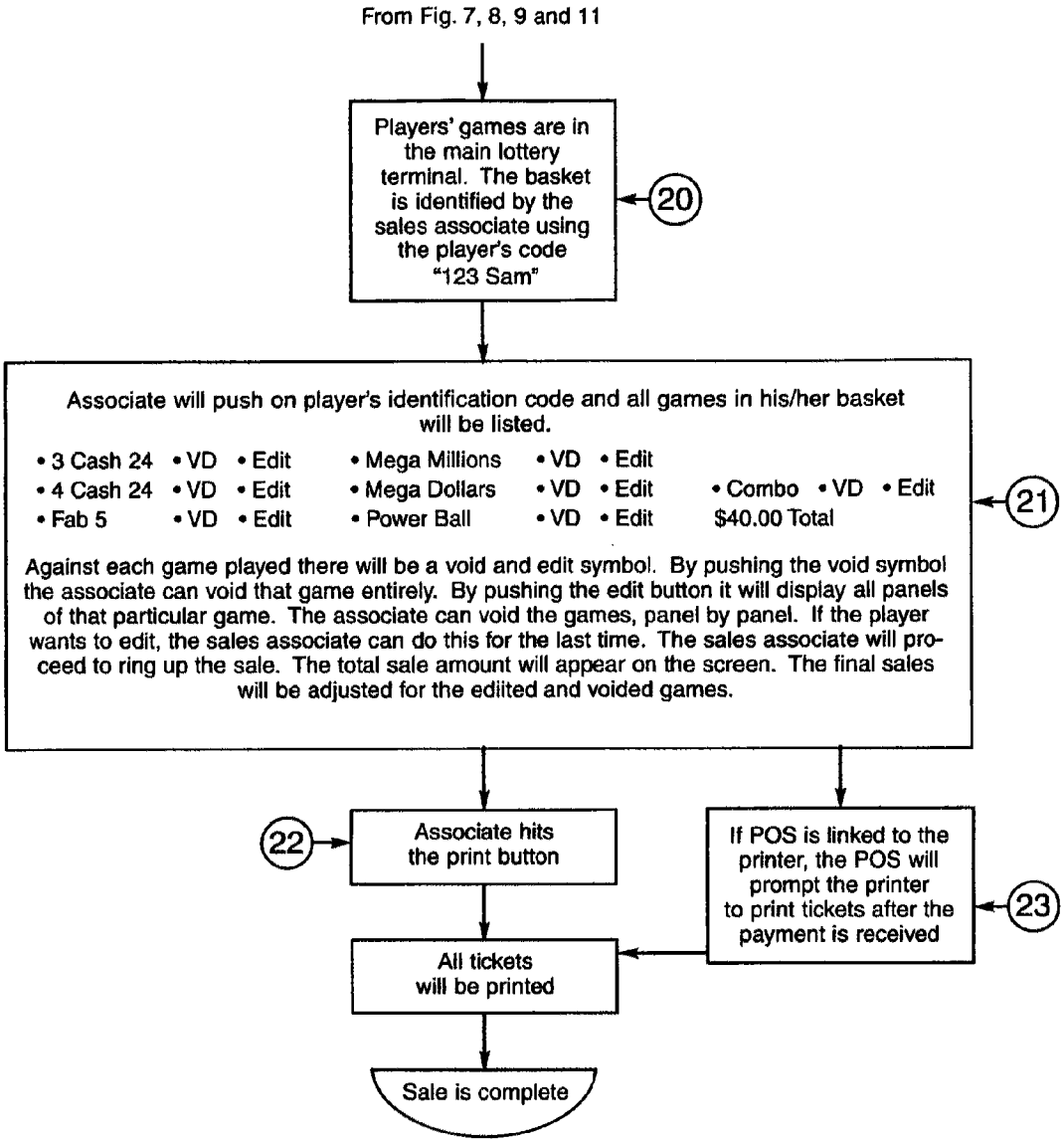

If the player chooses not to play any more games and decides to hit the send button, as described in FIG. 8, the box marked as #13, would result in the terminal following the flow chart as described in FIG. 8, box #14 and then to FIG. 10.

Figure 9:
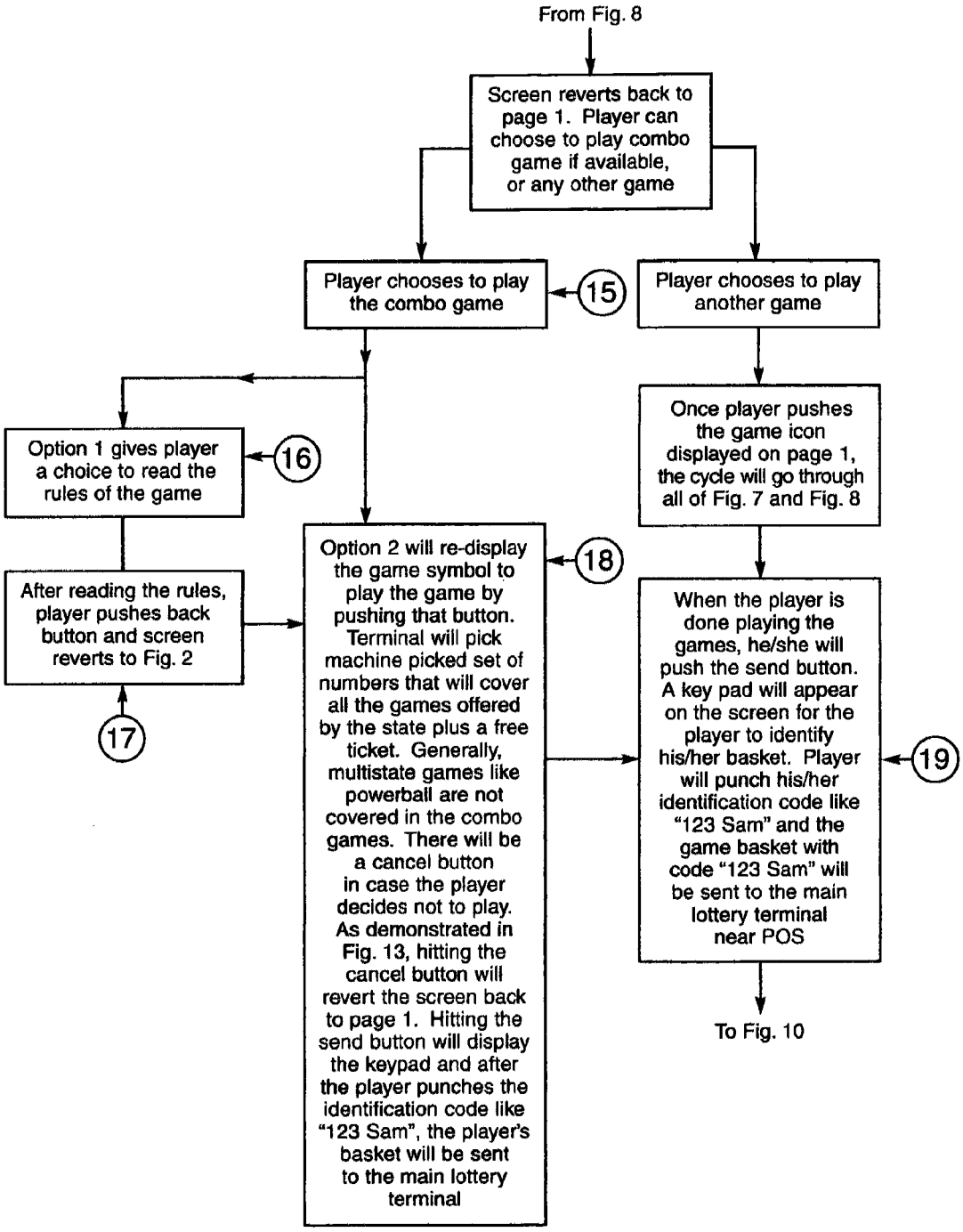

When player chooses to play the Combo game, events described in FIG. 9 will occur. Player chooses to play the Combo game box #15 refers. If the player chooses to play another game and not the combo game, events described in FIG. 7 and FIG. 8 will occur.

Player is given an option 1 to read the rules of the game, box #16, FIG. 9 refers. Player may read the rules and then push back button and then option #2, or may choose to go to option #2, without reading the rules, by pushing back button. In this case option #2 will re-display the combo game icon and pushing that icon will prompt the device to pick a set of machine picked numbers for all the games plus a set of numbers for the free game ticket (or just the instructions for the main lottery terminal to pick the set of numbers for the game) and store them in the player's basket. In case of the "Combo" game the player does not have an option to choose individual game numbers and multiple plays and multiple draws are not allowed. This game picks a set of numbers for the immediate next draw only, for all the games offered by the State, plus a set of numbers for the free game picked by the device. Besides the game icon in option #2, for this particular game only, there will be cancel button, in case the player decides not to play, FIG. 13 refers.

If player chooses to read the rules, when finished will hit the back button, box #17 FIG. 9 refers, and then option #2, to play the game.

Player hits option 2, the game icon will be re-displayed and there will be a cancel button too. When the game icon is hit, the terminal will pick a set of random numbers for all the games offered by the State and will do the same for the free ticket as well (or will generate instructions for the main lottery terminal to pick random set of numbers for the game). Multi-State games like Power Ball and Mega Ball are not covered by Combo games.

Combo games usually offer a free ticket to entice players to play all games, all at the same time. Box #18, FIG. 9 refers. If the player decides not to play the game and hits the cancel button, the screen will revert back to page 1.

When player is done playing all the games, he/she will push the "Send" button. The Key pad will appear on the screen as shown in FIG. 12, the player will punch in a code like "123 Sam" to identify his/hers basket at the main terminal. The basket will be sent to the main lottery terminal, near POS. Box #19, FIG. 9 refers.

Player's games are in the main lottery terminal. Sales associate identifies the player's basket by player's code "123Sam". Box #20, FIG. 10.

Sales associate will push the player's identification code and a list of all the games in the player's basket will appear on the main lottery terminal screen, FIG. 10, box #21 refers. The screen may look as follows:

| | | | | | | | | |
|---|---|---|---|---|---|---|---|---|
| *3 CASH 24 | *VOID | *EDIT | *MEGA MILLIONS | *VOID | *EDIT | | | |
| *4 CASH 24 | *VOID | *EDIT | *MEGA DOLLARS | *VOID | *EDIT | *COMBO | *VOID | *EDIT |
| *FAB 5 | *VOID | *EDIT | *POWERBALL | *VOID | *EDIT | | | |
| | | | TOTAL SALE $ 40.00 | | | | | |

Against each game played, there will be a "VOID" and "EDIT" symbol. By pushing the void symbol, the associate can void that game entirely or by pushing that edit button the associate will be able to edit the game panel by panel of that particular game. This is the last time player will be able to edit their games. The final sales will be adjusted for edited and voided games. The sales associate will proceed to ring up the sale and hit print button to print the tickets, either manually, FIG. 10 box #22 refers, or in case the POS terminal is linked to the printer, the POS will prompt the printer to print the tickets, FIG. 10, box #23 refers. That will conclude the sale.

Figure 11:
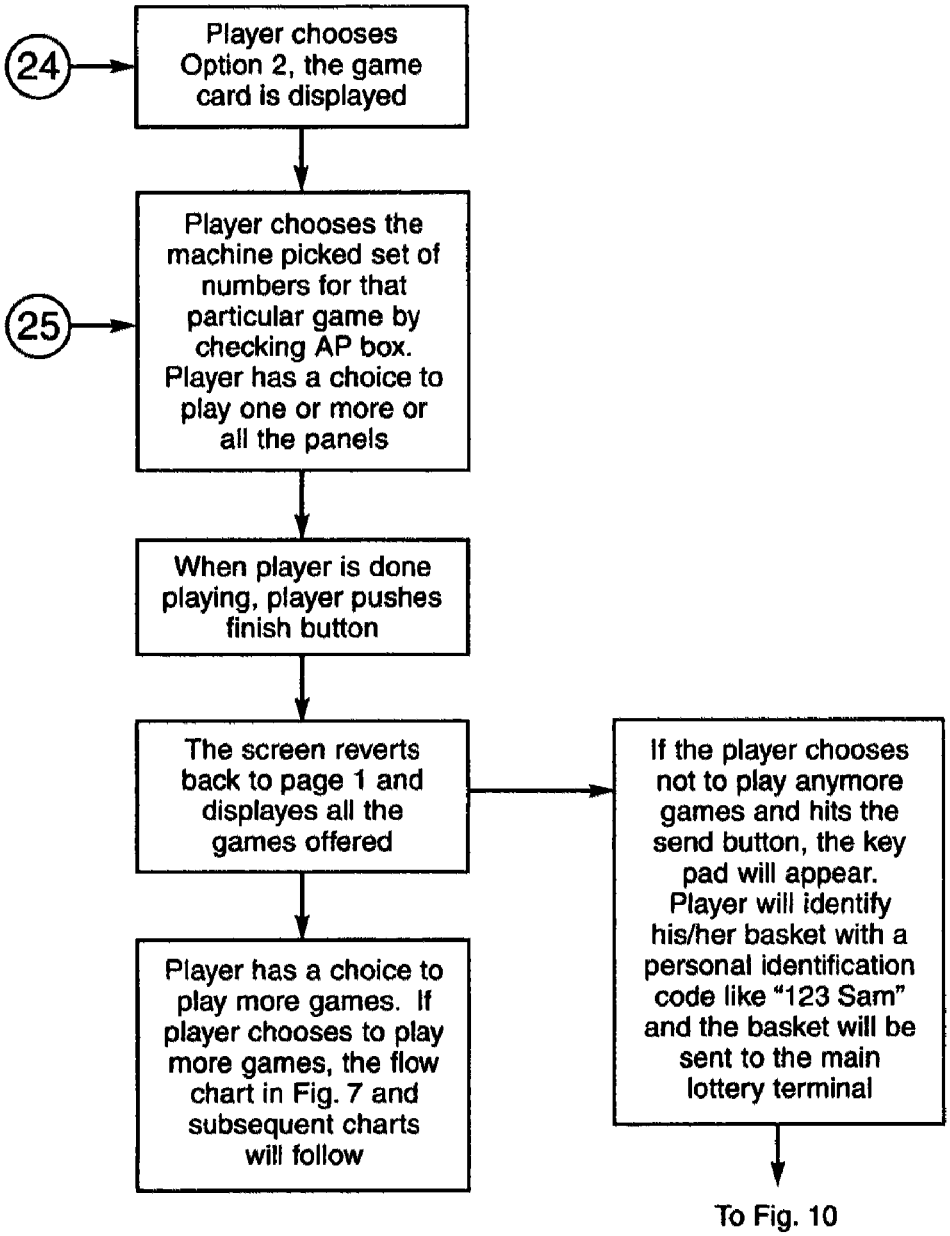

FIG. 11 shows the flow chart that will be applicable when player decides to play only machine picked set of numbers. Picking option #2, will display the game card, as shown in FIG. 11, box 24.

Player will check the tiny square box in the panel which says AP, short for auto pick or a set of machine picked set of numbers, for that panel. Player may check one or more panels or alternatively all the panels, FIG. 11, box 25 refers.

When player is done playing, will hit the finish button and that will revert the screen back to page 1. Player may choose to play more games, in which case the flow chart will follow the flow chart as explained in FIG. 7 and the subsequent charts. If the player chooses not to play any more games and hits the "Send" button the key pad will be displayed and the player will identify the player's basket with the identification code like "123SAM" than the flow chart will follow the path of flow cart as displayed in FIG. 10.

I claim:

1. A method of selling and the final printing of an on-line lottery game ticket, for purchase by a lottery game player within a store, the store having a networked lotto player's paperless terminal with the main lottery terminal and the main lottery terminal having the software to identify the games sent by the lotto player's paperless terminal and finally instruct the printer to print at least one lottery tickets, either manually by the sales associate or through the POS networked with the main lottery terminal, said method comprising the steps of: the game player making a game selection on a first page of the lotto player's paperless game terminal, directing the game player to a second page of the lotto player's paperless terminal for marking the required set of numbers, at least on one panel thereon, thus generating the lottery play numbers for onwards transmission to the on-site or off-site main lottery terminal; directing the user back to the first page; prompting the user to select another game selection, the combination of game selections forming a player's basket; to identify the player's basket, the player punching an identification code in the key pad before the final transmission of the game basket to the main lottery terminal; the lotto player's paperless terminal transmitting at least one game play either with a pick of player's own or machine picked set of numbers, to the main lottery terminal; the main lottery terminal detecting the game sent by the lotto player's paperless terminal with the player's identification code; the main lottery terminal networked with the ticket printer, instructing to print at least one on-line lotto game ticket, bearing the selected lottery play numbers thereon, the ticket printer printing at least one game ticket; the instruction to print the ticket is either initiated by the sales associate on receiving a payment or in case of a POS networked with the main lottery terminal receiving instruction of an amount to be charged for at least one lottery game ticket; whereby, the sales associate collects payment for, and delivers at least one lottery game ticket to the game player.

2. The method of claim 1, whereby the lotto player's paperless terminal stores the lottery play numbers and communicating the same numbers to an on-site main lottery terminal.

3. The method of claim 2, whereby the main lottery terminal receives the lottery play numbers and acting on the player's request to process the play.

4. The method of claim 3, the main lottery terminal receiving the lottery play numbers from the lotto player's paperless terminal and authorizing the lottery game ticket to be printed.

5. The method of claim 1, whereby the lotto player's paperless terminal communicates the amount to be charged to the main lottery terminal and the main lottery terminal detecting the same amount to be charged.

6. The method of claim 5, whereby, the amount to be charged is adjusted after editing at the main lottery terminal.

7. A method of selling and the final printing of an on-line lottery game ticket, for purchase by a lottery game player within a store, the store having a networked lotto player's paperless terminal with the main lottery terminal and the main lottery terminal having the software to identify the game(s) sent by the lotto player's paperless terminal and finally instruct the printer to print at least one lottery tickets, either manually by the sales associate or through the POS networked with the main lottery terminal, said method comprising the steps of: the game player making a game selection on a first page of the lotto player's paperless game terminal; directing the game player to a second page of the lotto player's paperless terminal for marking the required set of numbers, at least on one panel thereon, thus generating the lottery play numbers for onwards transmission to the on-site or off-site main lottery terminal; directing the user back to the first page; prompting the user to select another game selection, the combination of game selections forming a player's basket; to identify the player's basket, the player punching an identification code in the key pad before the final transmission of the game basket to the main lottery terminal; the lotto player's paperless terminal transmitting at least one game play either with a pick of player's own or machine picked set of numbers, to the main lottery terminal; the main lottery terminal detecting the game sent by the lotto player's paperless terminal with the player's identification code; the main lottery terminal networked with the ticket printer, instructing to print at least one on-line lotto game ticket, bearing the selected lottery play numbers thereon, the ticket printer printing at least one game ticket; the instruction to print the ticket is either initiated by the sales associate on receiving a payment or in case of a POS networked with the main lottery terminal receiving instruction of an amount to be charged for at least one lottery game ticket.

8. The method of claim 7, the store having a networked lotto player's paperless terminal with the main lottery terminal and the main lottery terminal having the software to identify the games sent by the lotto player's paperless terminal and finally instruct the printer to print the tickets, either manually by the sales associate or through the POS networked with the main lottery terminal.

9. The method of claim 7, the main lottery terminal database determines which type of game is to be played, that was sent by the lotto player's paperless terminal.

10. The method of claim 7, the game player verbally instructing a sales associate to edit at least one game in the player's basket, that was sent from the lotto player's paperless terminal to the main lottery terminal and the sales associate manually editing at least one game at the main lottery terminal, per the game player's instructions and printing at least one lottery game ticket.

11. A method of selling and the final printing of an on-line lottery game ticket, for purchase by a lottery game player within a store, the store having a networked lotto player's paperless terminal with the main lottery terminal and the main lottery terminal having the software to identify the games sent by the lotto player's paperless terminal and finally instruct the printer to print at least one lottery ticket, either manually by the sales associate or through the POS networked with the main lottery terminal, said method comprising the steps of: the game player making a game selection on a first page of the lotto player's paperless game terminal; directing the game player to a second page of the lotto player's paperless terminal for marking the required set of numbers, at least on one panel thereon, thus generating the lottery play numbers for onwards transmission to the on-site or off-site main lottery terminal; directing the user back to the first page; prompting the user to select another game selection, the combination of game selections forming a player's basket; to identify the player's basket, the player punching an identification code in the key pad before the final transmission of the game basket to the main lottery terminal; the lotto player's paperless terminal transmitting at least one game play either with a pick of player's own or machine picked set of numbers, to the main lottery terminal; the main lottery terminal detecting the game sent by the lotto player's paperless terminal with the player's identification code; the main lottery terminal networked with the ticket printer, instructing to print at least one on-line lotto game ticket, bearing the selected lottery play numbers thereon, the ticket printer printing at least one game ticket; the instruction to print the ticket is either initiated by the sales associate on receiving a payment or in case of a POS networked with the main lottery terminal receiving instruction of an amount to be charged for at least one lottery game ticket.

12. A system for use in selling an on-line lottery game ticket to a lottery game player within a store, the store having a networked lotto player's paperless terminal with the main lottery terminal and the main lottery terminal having the software to identify a player's basket of game(s) sent by the lotto player's paperless terminal and finally instruct the printer to print at least one ticket, either manually by the sales associate or through the POS networked with the main lottery terminal, said system comprising a computer to execute the steps of: the game player making a game selection on a first page of the lotto player's paperless game terminal; directing the game player to a second page of the lotto player's paperless terminal for marking the required set of numbers, at least on one panel thereon, thus generating the lottery play numbers for onwards transmission to the on-site or off-site main lottery terminal; directing the user back to the first page; prompting the user to select another game selection, the combination of game selections forming the player's basket; to identify the player's basket, the player punching an identification code in the key pad before the final transmission of the game basket to the main lottery terminal; the lotto player's paperless terminal transmitting at least one game play either with a pick of lotto player's own or machine picked set of numbers, to the main lottery terminal; the main lottery terminal with updated software to detect the player's basket and the game(s) sent by the lotto player's paperless terminal with the player's identification code; the main lottery terminal networked with the ticket printer, instructing to print at least one on-line lotto game ticket, bearing the selected lottery play numbers thereon, the ticket printer printing at least one game ticket; the instruction to print the ticket is either initiated by the sales associate on receiving a payment or in case of a POS networked with the main lottery terminal receiving instruction of an amount to be charged for at least one lottery game ticket.

13. The system of claim 12, whereby the main lottery terminal receives the lottery play numbers sent by the lotto player's paperless terminal and detects the game(s) and the play number(s) for the respective game(s).

14. The system of claim 12, wherein the main lottery terminal communicates to the ticket printer to print the ticket(s) for the game(s) sent by the lotto player's paperless terminal.

15. The system of claim 12, wherein the lotto player's paperless terminal communicates with the main lottery terminal and the main terminal detects the amount to be charged and communicates with the POS, if the POS is networked.

16. The system of claim 12, the lotto player's paperless terminal comprising a computer, said means for generating a request for the main lottery terminal to generate a random series of lottery play and the main lottery terminal receiving and detecting and acting on that request.

17. The system of claim 12, the lotto player's paperless terminal comprising a computer, said means for storing the lottery numbers played by the player for a particular game and storing set of numbers for different games and communicating them to the main lottery terminal, when the cluster of games, sent in as a basket with a player's identification tag, to the main lottery terminal and the same terminal receiving, detecting and acting on the request.

18. The system of claim 12, said lotto player's paperless terminal comprising a computer.

19. The system of claim 17, wherein the lotto player's paperless lottery terminal is networked with the main lottery terminal.

20. The system of claim 19, wherein the lotto player's paperless lottery terminal is networked through a wireless network.

21. The system of claim 19, wherein the lotto player's paperless lottery terminal could also be networked with wires.

22. A method of selling and the final printing of an on-line lottery game ticket, for purchase by a lottery game player within a store, the store having a networked lotto player's paperless terminal with the main lottery terminal and the main lottery terminal having the software to identify the games sent by the lotto player's paperless terminal and finally instruct the printer to print at least one lottery ticket, either manually by the sales associate or through the POS networked with the main lottery terminal, said method comprising the steps of: the game player making a game selection on a first page of the lotto player's paperless game terminal directing the game player to a second page of the lotto player's paperless terminal for marking the required set of numbers, at least on one panel thereon, thus generating the lottery play numbers for onwards transmission to the on-site or off-site main lottery terminal; directing the user back to the first page; prompting the user to select another game selection, the combination of game selections forming a player's baskets; to identify the player's basket, the player punching an identification code in the key pad before the final transmission of the game basket to the main lottery terminal; the lotto player's paperless terminal transmitting at least one game play either with a pick of player's own or machine picked set of numbers, to the main lottery terminal; the main lottery terminal detecting the game sent by the lotto player's paperless terminal with the player's identification code; the main lottery terminal networked with the ticket printer, instructing to print at least one on-line lotto game ticket, bearing the selected lottery play numbers thereon, the ticket printer printing at least one game ticket; the instruction to print the ticket is either initiated by the sales associate on receiving a payment or in case of a POS networked with the main lottery terminal receiving instruction of an amount to be charged for at least one lottery game ticket.

23. The method of claim 22, whereby on completion of the game, a single play, either randomly picked set of numbers, or the player's choice of selected set of numbers, and/or multiple panels for the same game, and/or multiple games, will all be lumped in one basket.

24. The method of claim 22, whereby the keypad will appear, when the send button is pressed, on completion of all the games and the player will identify his or her basket by punching a personal identification code.

25. The method of claim 24, whereby the keypad will show the player a time limit within which to approach the POS to pay for the game(s) played and obtain the final printed tickets and that the time limit will vary according to congestion at the main lottery terminal.

26. The method of claim 25, whereby failure by the player to obtain the final printed tickets within the time limit shown by the keypad will delete the player's basket of game(s).

27. The method of claim 24, whereby the personal identification code will be attached to the player's basket of games.

28. The method of claim 27, the basket will be identified by the player's personal identification code at the main lottery terminal.

29. The method of claim 22, whereby the player's basket will be attached with the total amount in local currency.

30. The method of claim 24, whereby on receipt of the player's basket of games, the sales associate will be able to identify the player's basket with player's personal identification code at the main lottery terminal.

31. The method of claim 22, whereby the sales associate will be able to open the player's basket at the main lottery terminal.

32. The method of claim 22, whereby the sales associate will be able to edit or void some or all the games in the player's basket, at the main lottery terminal.

33. The method of claim 32, whereby the sales amount will be adjusted at the main lottery terminal upon editing and/or voiding.

34. A system for use in selling an on-line lottery game ticket to a lottery game player within a store, the store having a networked lotto player's paperless terminal with the main lottery terminal and the main lottery terminal having the software to identify the player's basket of game(s) sent by the lotto player's paperless terminal and finally instruct the printer to print at least one ticket, either manually by the sales associate or through the POS networked with the main lottery terminal, said system comprising a computer to execute the steps of: the game player making a game selection on a first page the lotto player's paperless game terminal; directing the game player to a second page of the lotto player's paperless terminal for marking the required set of numbers, at least on one panel thereon, thus generating the lottery play numbers for onwards transmission to the on-site or off-site main lottery terminal; directing the user back to the first page; prompting the user to select another game selection, the combination of game selections forming the player's basket; to identify the player's basket, the player punching an identification code in the key pad before the final transmission of the game basket to the main lottery terminal; the lotto player's paperless terminal transmitting at least one game play either with a pick of lotto player's own or machine picked set of numbers, to the main lottery terminal; the main lottery terminal with updated software to detect the player's basket and the game(s) sent by the lotto player's paperless terminal with the player's identification code; the main lottery terminal networked with the ticket printer, instructing to print at least one on-line lotto game ticket, bearing the selected lottery play numbers thereon, the ticket printer printing at least one game ticket; the instruction to print the ticket is either initiated by the sales associate on receiving a payment or in case of a POS networked with the main lottery terminal receiving instruction of an amount to be charged for at least one lottery game ticket.

35. The system of claim 34, whereby all the games played will be lumped in a basket.

36. The system of claim 34, whereby the basket will be identified by punching the personal identification code of the player in the keypad.

37. The system of claim 36, whereby the keypad will show the player a time limit within which to approach the POS to pay for the game(s) played and obtain the final printed tickets and that the time limit will vary according to the congestion at the main lottery terminal.

38. The system of claim 37, whereby failure by the player to obtain the final printed tickets within the time limit shown by the key pad will delete the player's basket of games.

39. The system of claim 34, whereby the player's game basket will be sent to the main lottery terminal with a price tag.

40. The system of claim 34, whereby the sales associate will upon identifying the player's basket with the player's identification code, will be able to open the basket and edit or void all or certain games.

41. The system of claim 40, whereby the price will be adjusted at the main lottery terminal upon editing or voiding all or certain games, in the player's basket.

42. A method of selling and the final printing of an on-line lottery game ticket, for purchase by a lottery game player within a store, the store having a networked lotto player's paperless terminal with the main lottery terminal and the main lottery terminal having the software to identify the game(s) sent by the lotto player's paperless terminal and finally instruct the printer to print at least one lottery ticket, either manually by the sales associate or through the POS networked with the main lottery terminal, said method comprising the steps of: the game player making a game selection on a first page of the lotto player's paperless game terminal directing the game player to a second page of the lotto player's paperless terminal for marking the required set of numbers, at least on one panel thereon, thus generating the lottery play numbers for onwards transmission to the on-site or off-site main lottery terminal; directing the user back to the first page; prompting the user to select another game selection, the combination of game selections forming a player's basket; to identify the player's basket, the player punching an identification code in the key pad before the final transmission of the game basket to the main lottery terminal; the lotto player's paperless terminal transmitting at least one game play either with a pick of player's own or machine picked set of numbers, to the main lottery terminal; the main lottery terminal detecting the game sent by the lotto player's paperless terminal with the player's identification code; the main lottery terminal networked with the ticket printer, instructing to print at least one on-line lotto game ticket, bearing the selected lottery play numbers thereon, the ticket printer printing at least one game ticket; the instruction to print the ticket is either initiated by the sales associate on receiving a payment or in case of a POS networked with the main lottery terminal receiving instruction of an amount to be charged for at least one lottery game ticket.

43. The method of claim 42, whereby reverting back to page 1 and constantly offering the choices of games offered, at the end of each game played by the player on the lotto player's paperless terminal and prompting the player to play multiple plays and multiple draws, makes the device an active interactive on-line game selling tool.

44. A system for use in selling an on-line lottery game ticket to a lottery game player within a store, the store having a networked lotto player's paperless terminal with the main lottery terminal and the main lottery terminal having the software to identify a player's basket of game(s) sent by the lotto player's paperless terminal and finally instruct the printer to print at least one ticket, either manually by the sales associate or through the POS networked with the main lottery terminal, said system comprising a computer to execute the steps of: the game player making a game selection on a first page of the lotto player's paperless game terminal; directing the game player to a second page of the lotto player's paperless terminal for marking the required set of numbers, at least on one panel thereon, thus generating the lottery play numbers for onwards transmission to the on-site or off-site main lottery terminal; directing the user back to the first page; prompting the user to select another game selection, the combination of game selections forming the player's basket; to identify the player's basket, the player punching an identification code in the key pad before the final transmission of the game basket to the main lottery terminal; the lotto player's paperless terminal transmitting at least one game play either with a pick of lotto player's own or machine picked set of numbers, to the main lottery terminal; the main lottery terminal with updated software to detect the player's basket and the game(s) sent by the lotto player's paperless terminal with the player's identification code; the main lottery terminal networked with the ticket printer, instructing to print at least one on-line lotto game ticket, bearing the selected lottery play numbers thereon, the ticket printer printing at least one game ticket; the instruction to print the ticket is either initiated by the sales associate on receiving a payment or in case of a POS networked with the main lottery terminal receiving instruction of an amount to be charged for at least one lottery game ticket.

45. The system of claim 44, whereby the lotto player's paperless terminal is programmed to revert back to page 1 at the end of every game played by the player, and offer them the various choices of games offered, or alternatively offering them choices of multiple play or multiple draws, makes the device an active, interactive selling tool.

* * * * *